US005454683A

United States Patent [19]

Marom et al.

[11] Patent Number: 5,454,683

[45] Date of Patent: Oct. 3, 1995

[54] APPARATUS FOR REMOVING FLEXIBLE COVERS FROM BALES

[75] Inventors: Avi Marom; Gideon Shahaf, both of Kibbutz Ein Hamifratz, Israel

[73] Assignee: IMA Engineering Ltd., Mobile Post Oshrat, Israel

[21] Appl. No.: 294,747

[22] Filed: Aug. 23, 1994

[30] Foreign Application Priority Data

Aug. 27, 1993 [IL] Israel ..... 106818

[51] Int. Cl.[6] ..... B65B 69/00

[52] U.S. Cl. ..... 414/412; 29/564.3; 83/909

[58] Field of Search ..... 414/412, 411, 414/403; 53/381.2; 83/909; 29/564.3, 426.4, 426.3

[56] References Cited

U.S. PATENT DOCUMENTS

| | | | |
|---|---|---|---|
| 3,889,442 | 6/1975 | Grahn et al. | 414/412 X |
| 4,289,438 | 9/1981 | Murer | 414/412 |
| 4,610,596 | 9/1986 | Bouldin et al. | 414/412 |
| 4,929,141 | 5/1990 | Keesey et al. | 414/412 |
| 5,199,841 | 4/1993 | Von Gehlen | 414/412 |
| 5,318,399 | 6/1994 | Marom | 414/412 |
| 5,371,938 | 12/1994 | Martin | 29/564.3 |

FOREIGN PATENT DOCUMENTS

| | | | |
|---|---|---|---|
| 111644 | 4/1989 | Japan | 414/412 |
| 1613385 | 12/1990 | U.S.S.R. | 414/412 |

*Primary Examiner*—Michael S. Huppert
*Assistant Examiner*—James Eller
*Attorney, Agent, or Firm*—Ladas & Parry

[57] ABSTRACT

Apparatus for removing flexible covers from bales, includes a conveyor for conveying each bale from a loading station through a cutting station wherein the cover is cut, a stripping station wherein the cover is stripped from the bale, and a discharge station wherein the stripped bale is discharged. The cutting station includes a front blade assembly mounted on a carriage driven vertically along the length of the front wall of the cover for vertically slitting the front wall while the bale is relatively stationary on the conveyor, and then for horizontally slitting one of the end walls of the cover as the bale is conveyed towards the stripping station. An end wall blade assembly horizontally slits the other end wall of the cover as the bale is conveyed towards the stripping station.

19 Claims, 5 Drawing Sheets

APPARATUS FOR REMOVING FLEXIBLE COVERS FROM BALES

FIELD AND BACKGROUND OF THE INVENTION

The present invention relates to apparatus for removing flexible covers from bales. The invention is particularly useful for removing flexible covers (e.g., of plastic, jute, cotton, etc.) from cotton bales, and is therefore described below with respect to this application.

The flexible plastic covers commonly applied to cotton bales are generally removed manually at the present time, by manually slitting the covers and stripping them from the cotton bales. However, this is an extremely arduous and strenuous task because of the size and weight of such cotton bales. U.S. Pat. No. 4,610,596 discloses one type of automated apparatus particularly useful for removing flexible covers of baled soil material and the like such as are used in potted plants.

OBJECTS AND BRIEF SUMMARY OF THE INVENTION

An object of the present invention is to provide another form of automated apparatus for removing flexible covers from bales particularly useful for removing covers from bales of cotton, but also useful for removing covers of other types of baled products.

According to the present invention, there is provided apparatus for removing flexible covers from bales, each cover including front and rear walls, top and bottom end walls, and a pair of side walls, the apparatus comprising: a conveyor for conveying each bale from a loading station through a cutting station wherein the cover is cut, a stripping station wherein the cover is stripped from the bale, and a discharge station wherein the stripped bale is discharged; characterized in that the cutting station includes: a front blade assembly mounted on a carriage driven vertically along the length of the front wall of the cover for vertically slitting the front wall while the bale is relatively stationary on the conveyor, and then for horizontally slitting one of the end walls of the cover as the bale is conveyed towards the stripping station; and an end wall blade assembly for horizontally slitting the other end wall of the cover as the bale is conveyed towards the stripping station.

According to further features in the preferred embodiment of the invention described below, the end blade assembly is located to slit the bottom end wall of the bale cover, and the front blade assembly carriage is driven vertically upwardly to slit the front wall of the bale cover from its bottom end wall to its top end wall, when the bale is relatively stationary, and then to slit the top end wall of the cover as the bale is conveyed towards the discharge station.

According to still further features in the described preferred embodiment, the apparatus further includes a pusher assembly for pushing the bale through the cutting station and stripper station to the discharge station; more particularly, the conveyor includes a main conveyor section and a loading section at a right angle thereto, the pusher assembly being located at the juncture of the two conveyor sections.

According to still further features in the described preferred embodiment, the pusher assembly comprises a pusher plate engageable with the rear wall of the bale cover, and a plurality of pusher teeth pivotally mounted to pierce the rear wall of the bale cover in order to retain the cover as the bale is pushed by the pusher plate through the stripping station. The stripping station includes prongs located to pierce the front wall of the bale cover on opposite sides of the vertical slit therein, and then to move outwardly as the bale cover is pushed through the stripping station. The prongs are carried by arms extending parallel to the longitudinal axis of the conveyor at the stripping station and mounted on parallelograms effective to cause the prongs to move outwardly while retaining their parallel relation to the longitudinal axis. The stripping station includes further prongs fixed with respect to the conveyor and located to pierce the bottom wall of the bale cover as it is pushed through the stripping station.

According to still further features in the described preferred embodiment, the apparatus further includes ejector rolls at the discharge station for ejecting the cover after having been stripped from the bale in the stripping station.

Apparatus constructed in accordance with the foregoing features has been found particularly effective for removing flexible covers from cotton bales in an automated manner.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
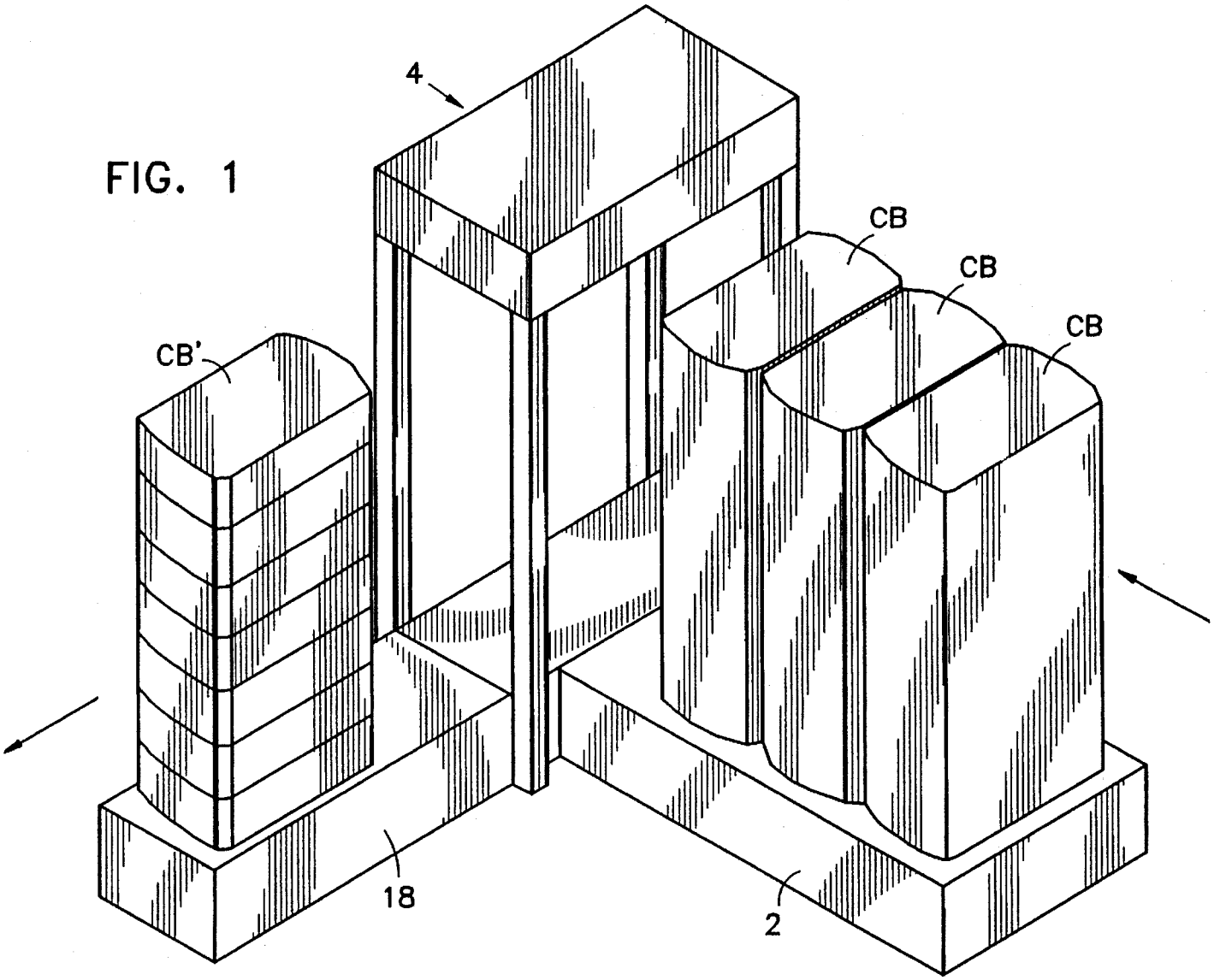
FIG. 1 pictorially illustrates one form of apparatus constructed in accordance with the present invention for removing flexible covers from bales.

The apparatus illustrated in the drawings is particularly useful for removing flexible covers from cotton bales CB. The apparatus includes a loading section 2 in which the cotton bales CB, each covered by a flexible cover, are loaded in a vertical position, and a main section 4, extending perpendicularly to the loading section 2, and in which the flexible cover of each cotton bale is cut and stripped from the cotton bale before the cotton bale is discharged as shown at CB' in FIG. 1.

The loading section 2 of the apparatus serves as a loading station for receiving the cotton bales CB. As shown particularly in FIG. 2, this loading station includes a plurality of rollers 10 extending perpendicularly to the axis of the loading station and driven by a motor $M_1$ (FIGS. 3 and 4) for conveying the bales into the main section 4 of the apparatus. A pusher assembly, generally designated 12, located at the rightmost end of the main section 4 (i.e., at the juncture with the loading section 2) pushes each cotton bale CB first through a cutting station 14, where the cotton bale cover is cut, and then through a stripping station 16, where the cover is stripped from the cotton bale, before the cotton bale is discharged at the discharge station 18.

The pusher assembly 12 is driven through the foregoing stations by a motor $M_2$ coupled to the pusher assembly 12 by a chain drive transmission 20.

Figure 3:
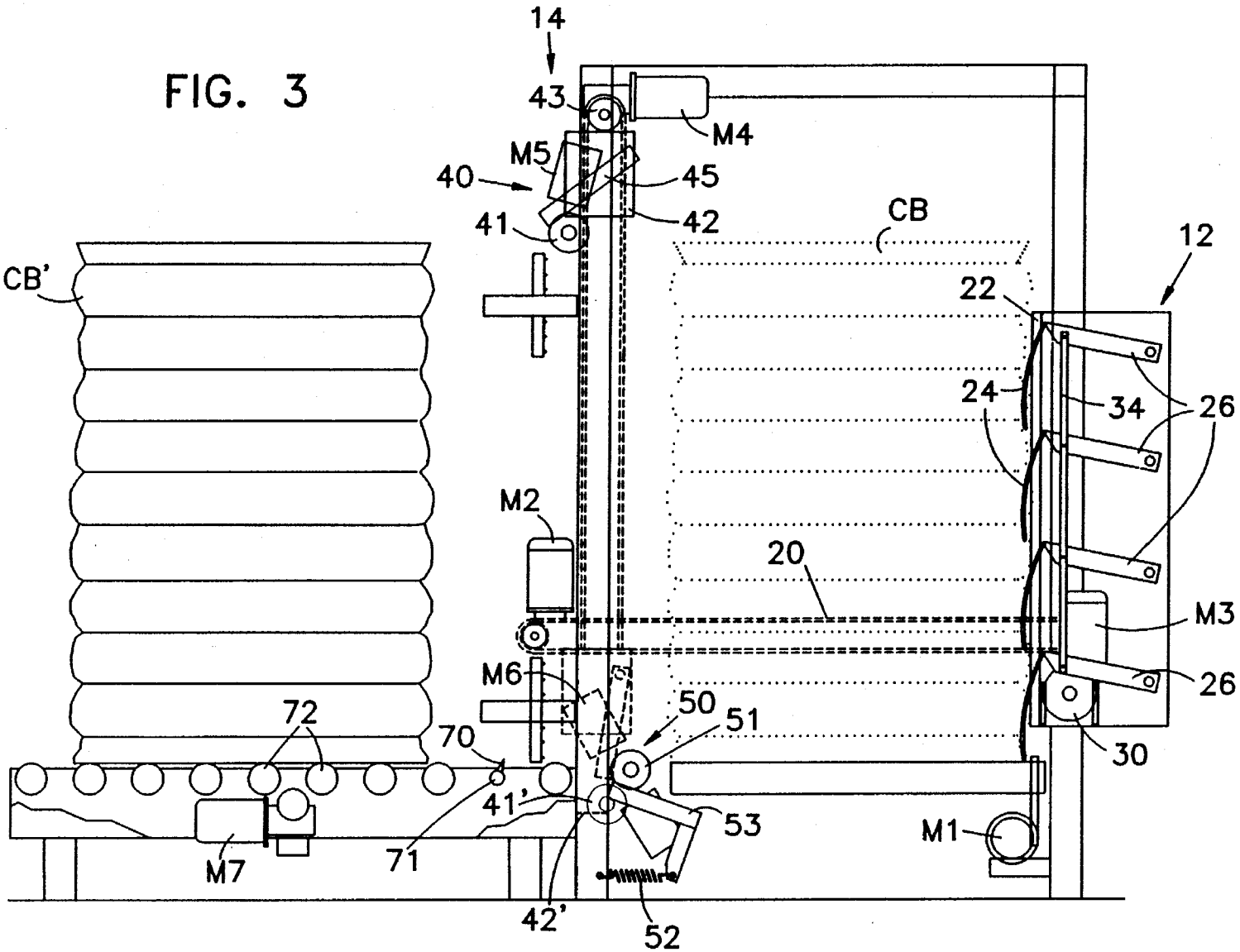
FIG. 3 is a side elevational view also illustrating the main elements in the apparatus of FIG. 1.
Figure 4:
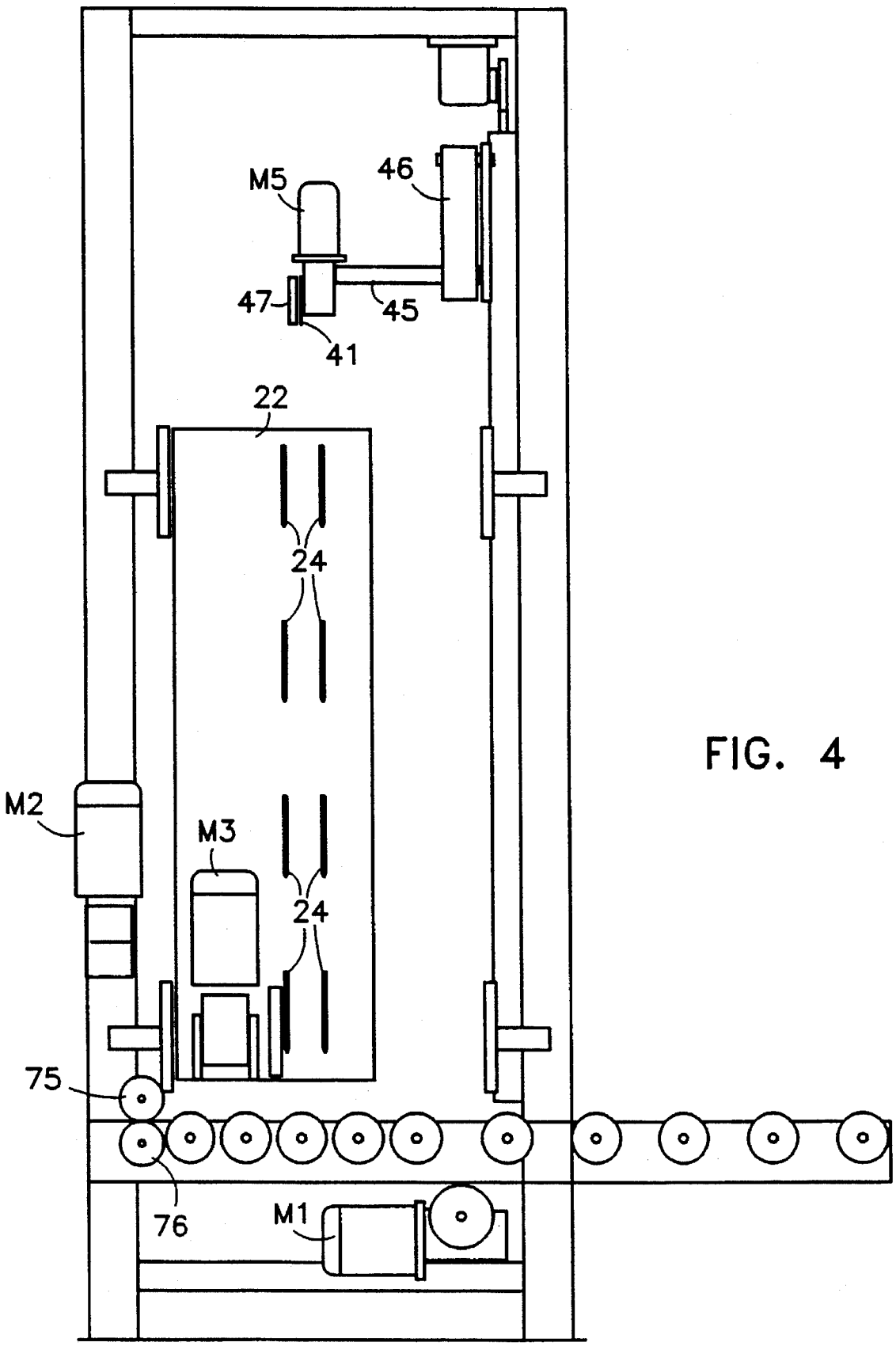
FIG. 4 is a front elevational view illustrating the apparatus of FIGS. 1–3.

The pusher assembly 12 is more particularly illustrated in FIGS. 3 and 4. It includes a vertically-extending pusher plate 22 adapted to contact the rear wall of the bale cover to push the covered bale through the main section 4 of the apparatus. Pusher assembly 12 further includes a plurality of pairs of teeth 24 which are pivotally mounted so as to pierce the rear wall of the cotton bale cover, to thereby aid in retaining the cover during the stripping operation as will be described more particularly below. There are four pairs of teeth 24 (FIG. 4), each pair being vertically spaced from the others.

Figure 5:
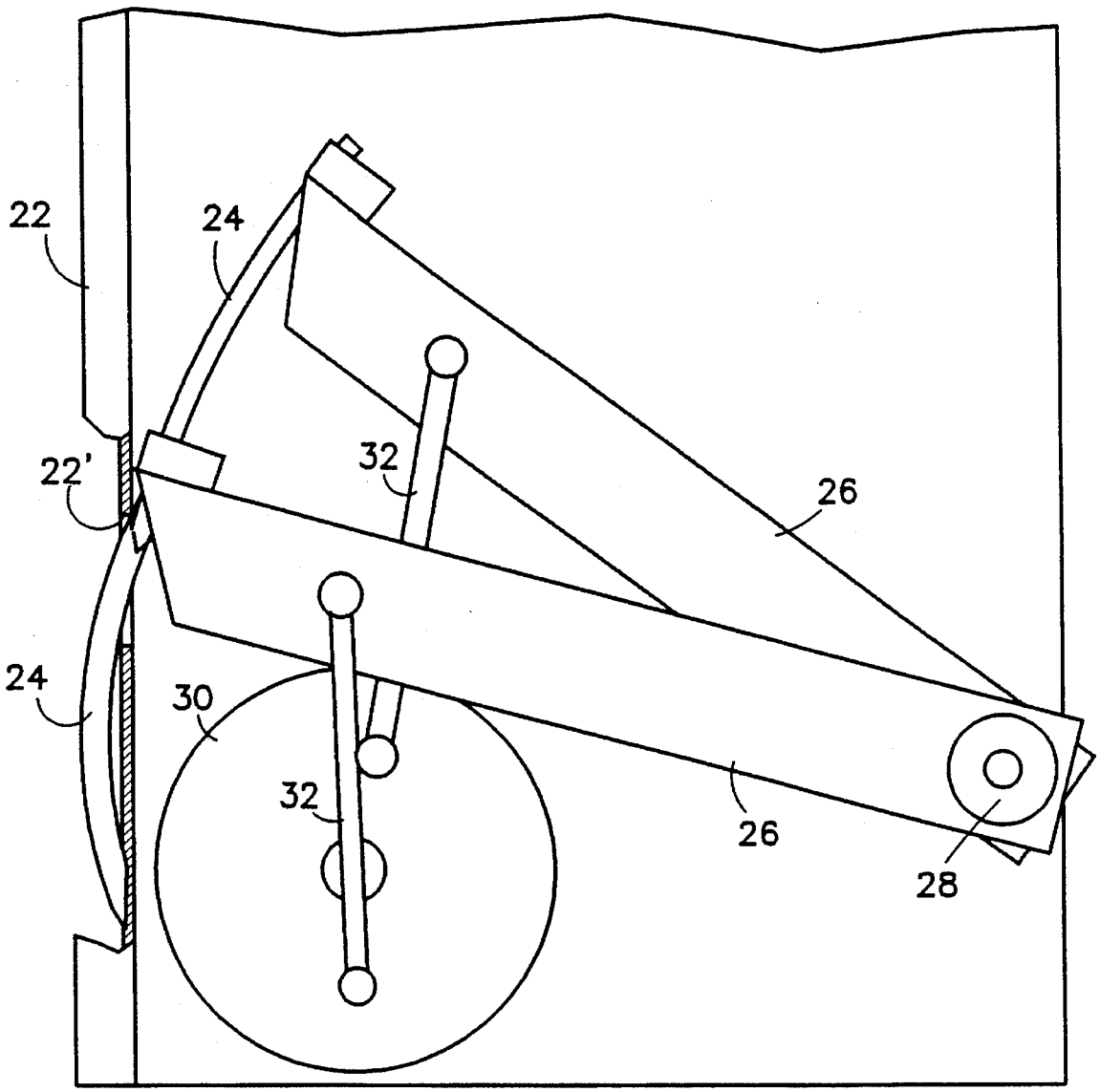
FIG. 5 is an enlarged side elevational view illustrating details of the pusher assembly in the apparatus of FIGS. 1–3.

As shown in FIG. 5, each tooth 24 is mounted to an arm 26 pivotal about axis 28 such that the tooth may be pivotted from an operative position (shown in full lines in FIG. 5) projecting through an opening 22' in the pusher plate 22, to a retracted position (shown in broken lines in FIG. 5) retracted within the pusher plate. The foregoing pivotal movements of teeth 24 are effected by a disc 30, and an eccentric coupling 32 from the disc to the arm 26 of the respective tooth 24. Disc 30 is rotated by a motor $M_3$ (FIG. 3), and all the arms 26 are coupled together by a common connecting rod 34 (FIG. 3), such that rotating motor $M_3$ will actuate all the teeth 24 together to their operative positions as shown in full lines in FIG. 5, or to their retracted positions as shown in broken lines in FIG. 5.

The cutting station 14 includes two blade assemblies: a front blade assembly, generally designated 40, which vertically slits the front wall of the bale cover and then horizontally slits its top wall; and an end blade assembly, generally designated 50, which horizontally slits the bottom wall of the bale cover.

The front blade assembly 40 includes a disc-shaped rotary blade 41 mounted on a carriage 42 which moves vertically across the front wall of the bale cover when the bale is relatively stationary within the apparatus. Carriage 42 is normally in its bottommost position, as shown by broken lines 42' in FIG. 3, such that the rotary blade 41 (shown at 41') is engageable with the bottom of the front wall of the bale cover. While the bale is relatively stationary on the conveyor and within the cutting station 14, carriage 42 is driven by a motor $M_4$, and a chain drive transmission 43, in the upward direction such that the rotary blade 41 makes a vertical slit centrally of the front wall of the bale cover. As soon as the vertical slit has been so made, the pusher assembly 12 then pushes the cotton bale CB towards the stripping station 16, such that blade 41 of the front blade assembly 40 now applies a horizontal cut to the top wall of the bale cover.

Blade 41 is rotated by a motor $M_5$ also mounted on the carriage 42. The rotary blade 41, together with its motor $M_5$, is carried by an arm 45 which is pivotally mounted to the carriage 42, and is biassed to firmly engage the bale cover by weights 46 (FIG. 4) mounted to arm 45. A disc 47 carried by the rotary blade 41, but of smaller diameter than it, limits the penetration of the rotary knife into the cotton bale when the knife severs its cover, to thereby minimize damage to the cotton within the bale.

The end wall blade assembly 50 similarly includes a rotary blade 51 rotated by a motor $M_6$. Rotary blade 51 is also biassed against the bale cover, but in this case, by a spring 52 carried at the end of an arm 53 pivotally mounting the rotary blade 51 (FIG. 3). Although not shown in FIG. 3, the rotary blade 51 also includes a disc, corresponding to disc 47 of blade assembly 40, for limiting the penetration of the blade into the cotton bale when the blade slits the bottom wall of the bale cover.

Figure 2:
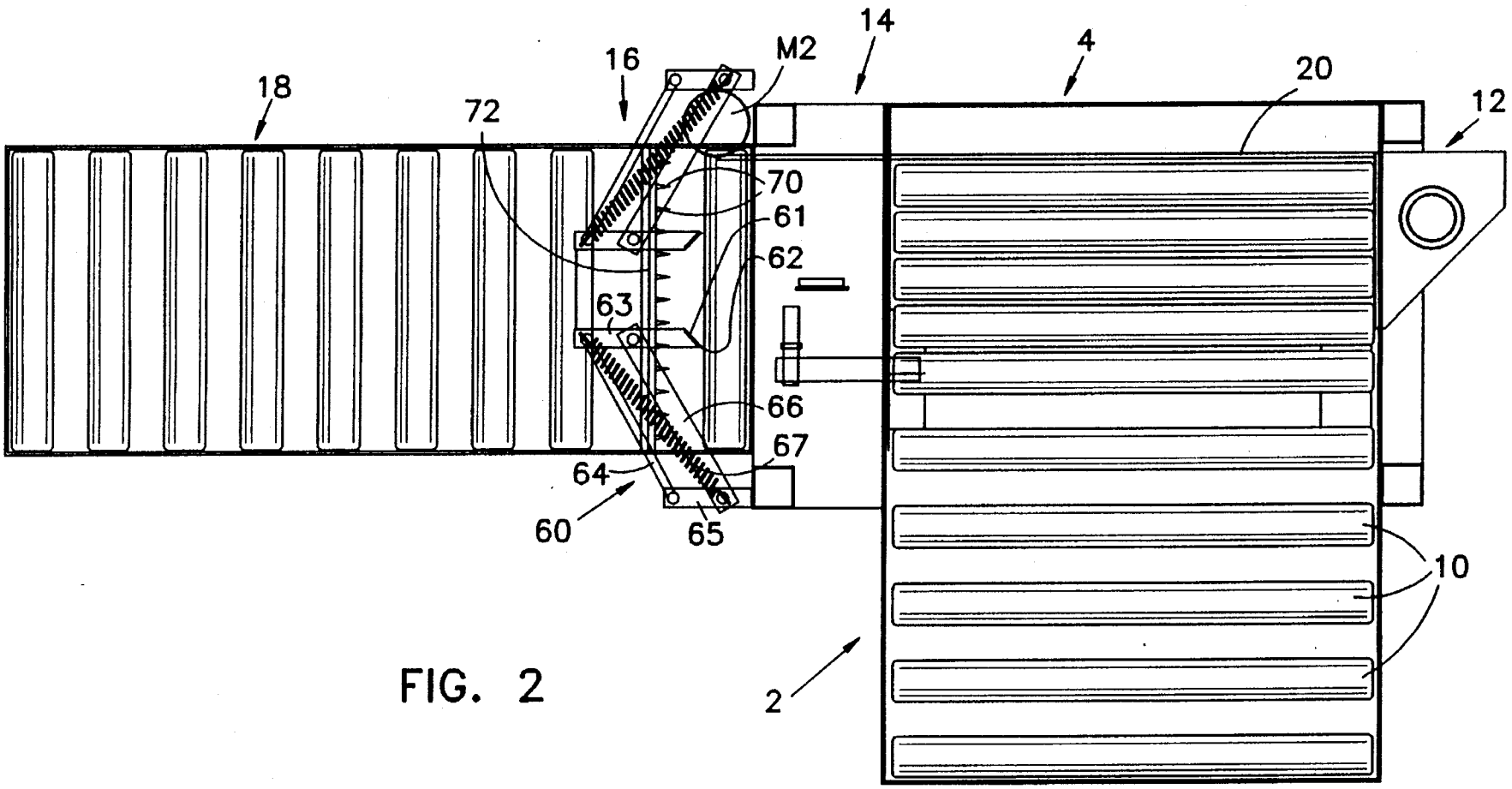
FIG. 2 is a top plan view illustrating the main elements in the apparatus of FIG. 1.

The stripping station 16 is best seen in FIG. 2. This station includes four stripping assemblies, each designated 60, two being located at the upper front side of the bale, and the other two being located at the lower front side of the bale, on opposite sides of the bale centerline as the bale is pushed through the stripping station.

Each stripping assembly 60 includes a plate 61 extending for a short vertical distance and carrying a plurality of prongs 62 along its length. Each plate 61 is carried by a parallelogram including the four links 63, 64, 65 and 66 pivotally mounted to each other and urged by a spring 67 to a normal position as illustrated in FIG. 2. The arrangement is such that spring 67 urges the parallelogram of links 63–66 to the position wherein plate 61 and its prongs 62 are normally located slightly outwardly of the centerline of the front wall of the bale cover as the bale cover is pushed into the stripping station 16.

The stripping station 16 includes further prongs 70 (FIG. 3) spaced along a rod 71 extending transversely across the conveyor at the stripping section 16, such that the prongs 70 pierce the bottom wall of the bale cover as the bale is pushed through the stripping station.

As shown particularly in FIG. 3, rod 71 carrying prongs 70 may be of the same size as, and aligned with, rollers 72 of this portion of the conveyor, except that rod 71 is fixed, whereas rollers 72 are rotatably mounted to permit the bale to be pushed thereover by the pusher assembly 12. When this occurs, however, the prongs 70 penetrating the bottom wall of the bale cover, together with prongs 62 penetrating the front wall of the bale cover on opposite sides of its vertical slit, together with the teeth 24 which penetrated the rear wall of the bale cover, retain the cover in the stripping station 16 as the bale is pushed out of the stripping station by the pusher assembly 12, thereby stripping the cover from the cotton bale. When the cover has thus been removed from the bale, it falls by gravity to the bottom of the conveyor and is ejected therefrom by ejector rollers 75, 76 (FIG. 4).

The illustrated apparatus operates as follows: As the covered cotton bales CB are loaded in a vertical position at the loading station 2 of the apparatus, the rollers 10 (FIG. 2) at the loading station convey the bales individually into the apparatus such as to bring the bale into alignment with the pusher assembly 12. The pusher assembly 12 is then actuated, first to pivot its teeth 24 from their normal retracted positions (illustrated in broken lines in FIG. 5) to their operative positions wherein they project through openings 22' in pusher plate 22 and penetrate the rear wall of the bale cover.

At this time the bale is still relatively stationary with respect to the conveyor, and the front blade assembly 40 is located at the bottom of the bale such that its blade 41 is aligned with the centerline of the front wall of the cover at the lower end of that wall, and is pressed into firm contact with the bale cover front wall.

Motor $M_4$ of the front blade assembly 40 is then actuated to move its carriage 42 vertically along the front wall of the bale cover, so that blade 41 applies a vertical slit to the cover front wall. As soon as the blade reaches the upper end of the cover front wall, its blade 41 becomes aligned with the centerline of the top wall of the bale cover, whereas the blade 51 of the end wall blade assembly 50 becomes aligned with the centerline of the bottom wall of the bale cover.

Pusher assembly 12 is then actuated by motor $M_2$ to push the bale through the cutting station 14 and into the stripping station 16. During this movement of the bale, blade 41 of assembly 40, and blade 51 of assembly 50, apply horizontal slits to the top and bottom walls, respectively, of the bale cover.

As the bale is further pushed by the pusher assembly 12, prongs 62 of the four stripper assemblies 60 engage and penetrate the front wall of the bale cover on opposite sides of its vertical slit. As the bale is further pushed through the stripping station 16, the prongs 62 carried by the parallelogram linkage 63–66 are pivotted outwardly against the action of spring 67, but the parallelogram linkage retains the prongs 62 parallel to the longitudinal axis of the conveyor. In addition, the prongs 70 carried by the fixed rod 71 at the bottom of the conveyor engage and pierce the bottom wall of the bale cover.

It will thus be seen that as the pusher assembly 12 further pushes the bale through the stripping station 16, the bale cover is retained in the stripping station by the teeth 24 piercing its rear wall, prongs 62 piercing its front wall on opposite sides of its vertical slit and moving outwardly, and prongs 70 piercing its bottom wall. The bale cover is thus retained within the stripping station 16 as the bale itself is moved out of the stripping station to the discharge station 18 by the rollers 72 driven by motor $M_7$. As soon as the bale has moved out of the stripping station 16, the teeth 24 of the pusher assembly are retracted, whereupon the cover falls by gravity to the bottom of the conveyor and is ejected by ejector rolls 75, 76 (FIG. 4).

While the invention has been described with respect to one preferred embodiment, it will be appreciated that this is set forth merely for purposes of example, and that many variations, modifications and other applications of the invention may be made.

We claim:

1. Apparatus for removing flexible covers from bales, each cover including front and rear walls, top and bottom end walls, and a pair of side walls, said apparatus comprising: a conveyor for conveying each bale from a loading station through a cutting station wherein the cover is cut, a stripping station wherein the cover is stripped from the bale, and a discharge station wherein the stripped bale is discharged; said cutting station comprising:

a carriage:

a front blade assembly mounted on said carriage; means for driving said carriage and said front blade assembly vertically along the length of the front wall of the cover for vertically slitting said front wall while the bale is relatively stationary on the conveyor, and then for horizontally slitting one of the end walls of the cover as the bale is conveyed toward said stripping station:

and an end wall blade assembly for horizontally slitting the other end wall of the cover as the bale is conveyed towards said stripping station.

2. The apparatus according to claim 1, wherein said end wall blade assembly is located to slit the bottom end wall of the bale cover, and said front blade assembly carriage is driven vertically upwardly to slit the front wall of the bale cover from its bottom end wall to its top end wall, when the bale is relatively stationary, and then to slit the top end wall of the cover as the bale is conveyed towards said discharge station.

3. The apparatus according to claim 2, further including a pusher assembly for pushing the bale through said cutting station and said stripping station to said discharge station.

4. The apparatus according to claim 3, wherein said conveyor includes a main conveyor section and a loading conveyor section at a right angle thereto, said pusher assembly being located at the juncture of said two conveyor sections.

5. The apparatus according to claim 3, wherein said pusher assembly comprises a pusher plate engageable with the rear wall of the bale cover, and a plurality of pusher teeth pivotally mounted to pierce said rear wall of the bale cover in order to retain the cover as the bale is pushed by said pusher plate through the stripping station.

6. The apparatus according to claim 5, wherein said stripping station includes prongs located to pierce the front wall of the bale cover on opposite sides of the vertical slit therein, and then to move outwardly as the bale cover is pushed through the stripping station.

7. The apparatus according to claim 6, wherein said prongs are carried by arms extending parallel to the longitudinal axis of the conveyor at said stripping station and mounted on parallelograms effective to cause the prongs to move outwardly while retaining their parallel relation to said longitudinal axis.

8. The apparatus according to claim 6, wherein said stripping station includes further prongs fixed with respect to the conveyor and located to pierce the bottom wall of the bale cover as it is pushed through the stripping station.

9. The apparatus according to claim 1, further including ejector rolls for ejecting the cover after having been stripped from the bale in the stripping station.

10. The apparatus according to claim 1, wherein said front blade assembly and said end wall blade assembly each includes a rotary blade and biassing means for pressing the blade against the respective wall of the cover.

11. Apparatus for removing flexible covers from bales, each cover including front and rear walls, top and bottom end walls, and a pair of side walls, said apparatus comprising:

a conveyor for conveying each bale from a loading station through a cutting station wherein the cover is cut, a stripping station wherein the cover is stripped from the bale, and a discharge station wherein the stripped bale is discharged;

said cutting station comprising: a carriage; a front blade assembly mounted on said carriage; means for driving said carriage and said front blade assembly vertically along the length of the front wall of the cover for vertically slitting said front wall while the bale is relatively stationary on the conveyor, and then for horizontally slitting one of the end walls of the cover as the bale is conveyed towards said stripping station; and an end wall blade assembly for horizontally slitting the other end wall of the cover as the bale is conveyed towards said stripping station;

and a pusher assembly for pushing the bale through said cutting station and stripper station to said discharge station.

12. The apparatus according to claim 11, wherein said end wall blade assembly is located to slit the bottom end wall of the bale cover, and said front blade assembly carriage is driven vertically upwardly to slit the front wall of the bale cover from its bottom end wall to its top end wall, when the bale is relatively stationary, and then to slit the top end wall of the cover as the bale is conveyed towards said discharge station.

13. The apparatus according to claim 11, wherein said conveyor includes a main conveyor section and a loading section at a right angle thereto, said pusher assembly being located at the juncture of said two conveyor sections.

14. The apparatus according to claim 11, wherein said pusher assembly comprises a pusher plate engageable with the rear wall of the bale cover, and a plurality of pusher teeth pivotally mounted to pierce said rear wall of the bale cover in order to retain the cover as the bale is pushed by said pusher plate through the stripping station.

15. The apparatus according to claim 14, wherein said stripping station includes prongs located to pierce the front wall of the bale cover on opposite sides of the vertical slit therein, and then to move outwardly as the bale cover is pushed through the stripping station.

16. The apparatus according to claim 15, wherein said prongs are carried by arms extending parallel to the longitudinal axis of the conveyor at said stripping station and mounted on parallelograms effective to cause the prongs to move outwardly while retaining their parallel relation to said longitudinal axis.

17. The apparatus according to claim 16, wherein said stripping station includes further prongs fixed with respect to the conveyor and located to pierce the bottom wall of the bale cover as it is pushed through the stripping station.

18. The apparatus according to claim 11, further including ejector rolls for ejecting the cover after having been stripped from the bale in the stripping station.

19. The apparatus according to claim 11, wherein said front blade assembly and said end wall blade assembly each includes a rotary blade and biassing means for pressing the blade against the respective wall of the cover.

* * * * *